US005295767A

United States Patent [19]

Taki

[11] Patent Number: 5,295,767

[45] Date of Patent: Mar. 22, 1994

[54] STABILIZER FOR AN IN SITU COLUMN DRILLING APPARATUS

[76] Inventor: Osamu Taki, 2558 Somerset Dr., Belmont, Calif. 94002

[21] Appl. No.: 904,837

[22] Filed: Jun. 26, 1992

[51] Int. Cl.[5] ..... E02D 7/00

[52] U.S. Cl. ..... 405/233; 405/232; 405/254; 405/253

[58] Field of Search ..... 405/232, 233, 236, 237, 405/240, 245, 246, 253, 254

[56] References Cited

U.S. PATENT DOCUMENTS

| | | | |
|---|---|---|---|
| 4,397,588 | 8/1983 | Goughnour | 405/236 |
| 4,637,758 | 1/1987 | Tamaki et al. | 405/232 X |
| 4,793,740 | 12/1988 | Schellhorn | 405/232 |
| 4,886,400 | 12/1989 | Taki et al. | 405/233 X |
| 4,906,142 | 3/1990 | Taki et al. | 405/233 X |
| 4,909,675 | 3/1990 | Taki . | |
| 5,006,016 | 4/1991 | Fukuda | 405/236 X |
| 5,007,770 | 4/1991 | Simmons et al. | 405/236 X |
| 5,013,185 | 5/1991 | Taki . | |
| 5,013,191 | 5/1991 | Kitanaka | 405/233 |
| 5,118,223 | 6/1992 | Taki . | |

FOREIGN PATENT DOCUMENTS 29375 6/1983 Japan .

*Primary Examiner*—Randolph A. Reese
*Assistant Examiner*—J. Russell McBee
*Attorney, Agent, or Firm*—Greg T. Sueoka

[57] ABSTRACT

A stabilizer for an in situ column drilling apparatus comprises a first and second mounting arms, a first and second stabilizing members, and a first and second stabilizing tabs. The mounting arms are adapted for rotatable coupling to the shaft of column drilling systems. The first and second mounting arms are preferably positioned spaced apart along the shaft near the drilling auger. The mounting arms are coupled together by two stabilizing members at opposite ends of the arms distal the shaft. The stabilizing members are advantageously shaped to fit closely against the wall of the column to prevent changes in the auger's drilling course. The first and second stabilizing tabs are attached to the first and second stabilizing members, respectively. The first and second tabs are mounted to extend radially outward from the shaft and also prevent changes in the auger's drilling course.

10 Claims, 7 Drawing Sheets

STABILIZER FOR AN IN SITU COLUMN DRILLING APPARATUS

BACKGROUND OF THE INVENTION

1. Field of the Invention

The present invention relates to devices for in situ mixing to produce soil-cement columns. In particular, the present invention relates to a stabilizer for an auger that provides for straight accurate drilling of in situ soil-cement columns even in horizontal directions.

2. Description of Related Art

A method for soil solidification and stabilization is the construction of soil-cement columns. Soil-cement columns are conventionally constructed by mixing soil with a chemical hardener in situ. The need for excavating the soil, mixing the soil with the chemical hardener, and then replacing the mixed soil and hardener in the excavation site is advantageously avoided by using a one step process with special augers and shafts that mix soil and a chemical hardener while the soil remains under ground near its original position. Typically, the auger shaft performs the two functions: (1) rotating to drive the auger and to mix the soil, and (2) providing a path for injection of the chemical hardener during the mixing process. Conventional soil-cement column augers are disclosed in U.S. Pat. Nos. 4,9002,172 issued to Fukuda; 4,909,675 issued to Taki; 5,013,185 issued to Taki and Japanese patent Nos. 1197295 and 1197296.

One continuing problem in constructing soil-cement columns is the ability to form them in accurate inclined and horizontal directions. FIG. 1 illustrates a cross-sectional view of a hillside and a soil-cement column constructed in an inclined direction (perpendicular to the surface). The axis upon which the column was to be formed is shown by the dashed line. As can be seen, the auger is effected by gravity, and as the column is mixed and injected with cement the auger veers from its intended course downward. Similarly shown in FIG. 1B, the problem is more server when constructing a soil cement column in substantially horizontal direction. The column formed in FIG. 1B in nowhere near its intended path at the bottom of the column.

The prior art has attempted to resolve this problem by using rods with greater rigidity and strength to compensate for the forces of gravity and retain the auger on its intended path. To increase the strength off the drilling shaft, its size, in particular the diameter, must be increased. However, one problem with increasing the size of the shaft is there is less area for mixing blades and the efficiency in mixing the soil with a hardening agent decreases. Increasing the size of shaft also increases the volume of the column occupied by the drill which results in more exposed soil being produced. This is a significant problem because it adversely effects the strength of the column being constructed. The less the soil and hardening agent are mixed, the less the strength of the column. Thus, there a need for a system that will provide maximum mixing of soil and hardening agent, and allow columns to be constructed in the horizontal or inclined directions.

SUMMARY OF THE INVENTION

The present invention overcomes the deficiencies of the prior art by providing a stabilizer for soil-cement column drilling augers. A preferred embodiment of the stabilizing system of the present invention comprises a first and second mounting arms, a first and second stabilizing members, and a first and second stabilizing tabs. The mounting arms are adapted for rotatable coupling to the shaft of soil-cement column drilling systems. The first and second mounting arms are preferably positioned spaced apart along the shaft near the drilling auger. The mounting arms are coupled together by two stabilizing members at opposite ends of the arms distal the shaft. The stabilizing members are advantageously shaped to fit closely against the wall of the area mixed by the auger thereby preventing a change in the auger's drilling course in a first direction. The first and second stabilizing tabs are attached to the first and second stabilizing members, respectively. The first and second tabs are mounted in a position parallel to the longitudinal axis of the shaft and extend radially outward from the shaft. Thus, the tabs advantageously prevent a change in the auger's drilling course in a second direction perpendicular to the first direction.

DETAILED DESCRIPTION OF THE PREFERRED EMBODIMENTS

Figure 1A:
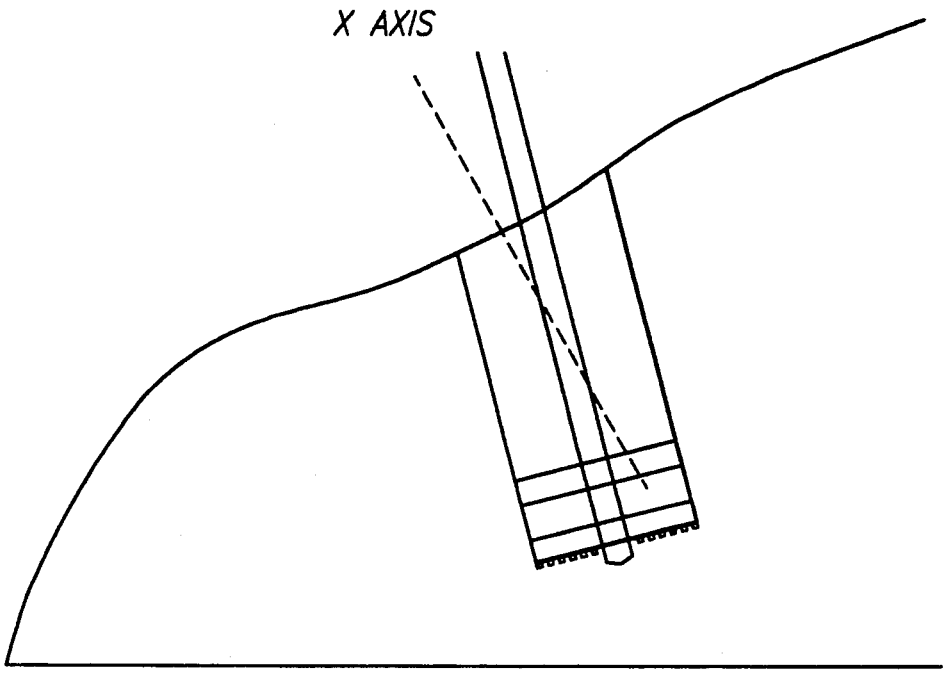
FIGS. 1A and 1B are cross-sectional views of the columns produced by drilling systems of the prior art.
Figure 1B:
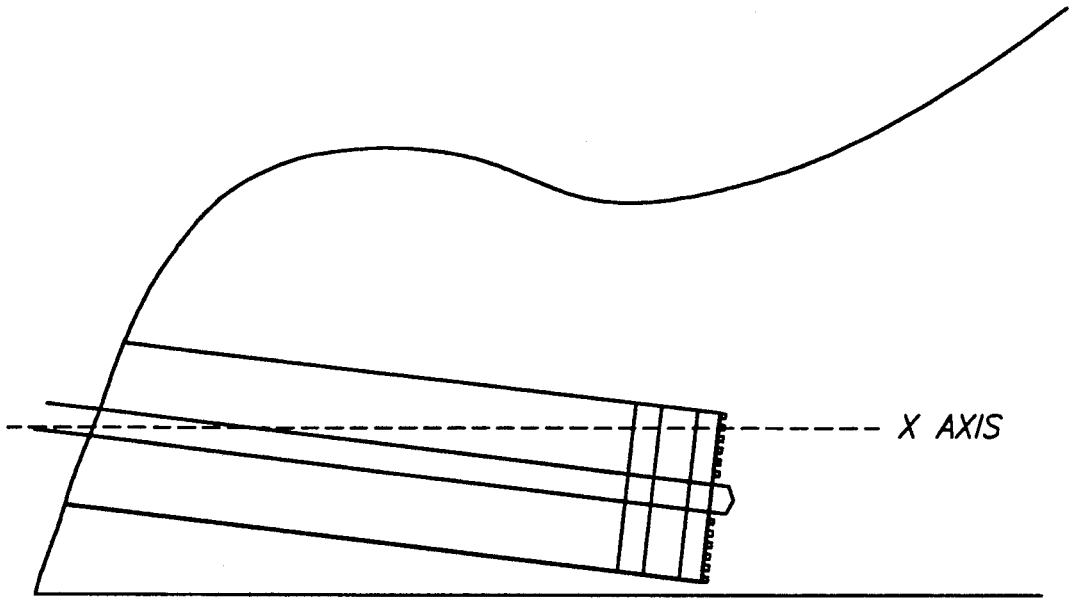
Figure 2:
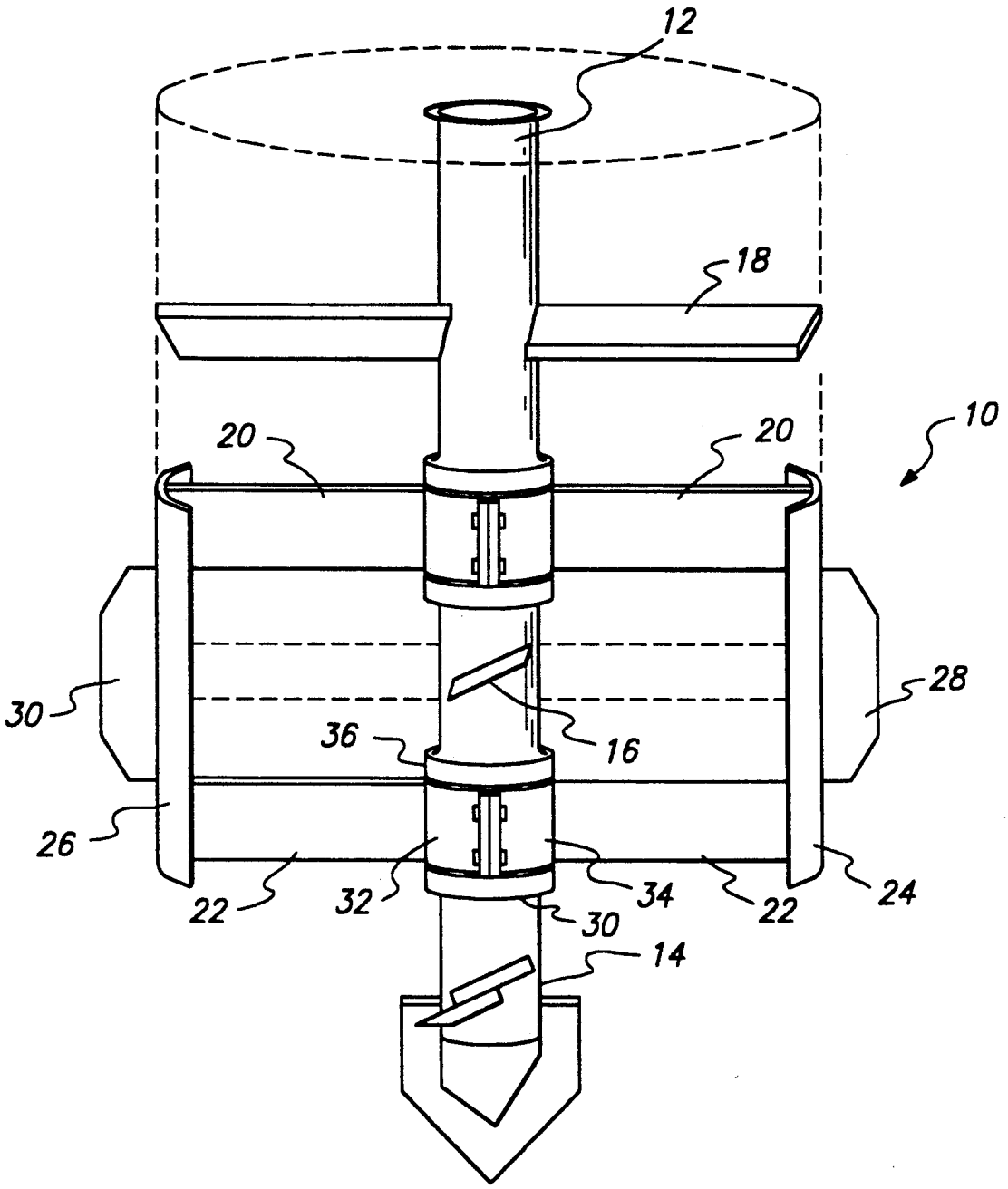
FIG. 2 is a perspective view of a preferred embodiment of the stabilizer of the present invention mounted on a drilling system.
Figure 3A:
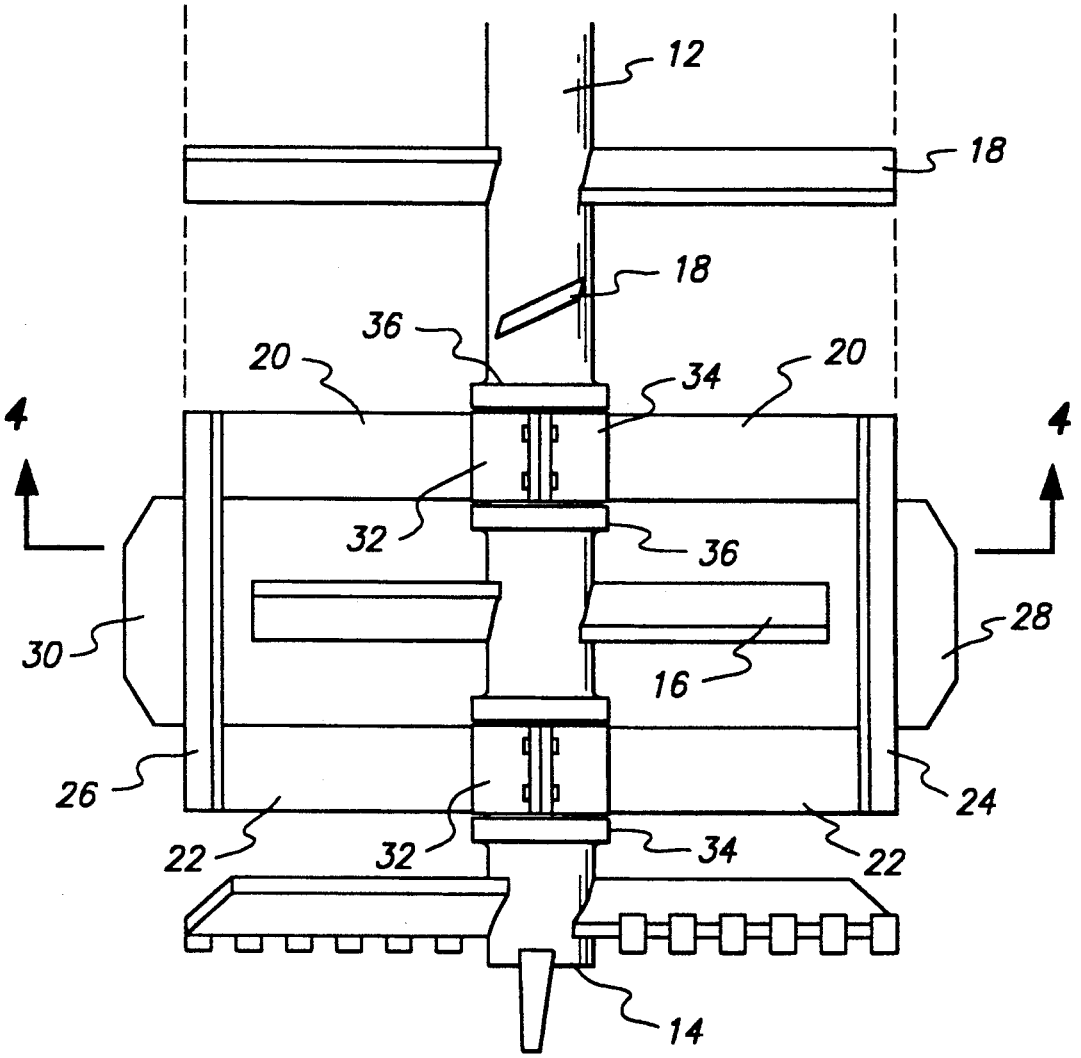
FIG. 3A is a side view of the preferred embodiment of the stabilizer of the present invention mounted on the drilling system.

Referring now to FIGS. 2 and 3, a preferred embodiment of a stabilizer 10 constructed in accordance with the present invention is shown. FIG. 2 illustrates a perspective view of the stabilizer 10 mounted on a soil-cement column drilling apparatus comprising a shaft 12, an auger bit 14 and a plurality of mixing blades 16, 18. In the preferred embodiment, the shaft 12 has a diameter as small as possible, for example, about 3–5 inches. The diameter of the shaft 12 needs to be small to maximize the mixing efficiency while also having a diameter sufficient to rotate the head 14 and blades 16, 18 at high speeds. Typically, the shaft 12 is constructed of materials with little flexibility such as steel pipes. The auger bit 14 is mounted on the lower end of the shaft 12. The auger bit 14 is of a conventional type as known in the art. The blades 16, 18 are also attached to the shaft 12 spaced apart along its longitudinal axis above the auger bit 14. The blades 16, 18 are also of a conventional type as known in the art and may be straight or teethed. The auger bit 14 and the blades 16, 18 are mounted to rotate with the shaft 12 and mix the soil as the shaft 12 progresses downward. The soil is first broken up by the auger bit 14, and then a column having a diameter equal to the length of the blade of the bit 14 and blades 18 is formed as the soil is mixed. As shown by FIG. 3A, the length of blade 16 is preferably slightly less than blade 18 and bit 14. Blade 16 has a slightly reduced length to permit rotation within the stabilizer 10. In an exemplary embodiment, blade 18 and bit 14 have a length of about three feet, and blade 16 has a length 1.5–2 inches shorter.

The resistance of the soil to the drill bit 14 and its associated distortion cause the auger bit 14 to stray along a curved path away from its intended linear path. The present invention overcomes this problem by providing the stabilizer 10 that is attached to the drilling apparatus proximate the auger bit 14. A preferred embodiment of the stabilizer 10 of the present invention comprises a first and second mounting arms 20, 22, a first and second stabilizing members 24, 26, a first and second stabilizing tabs 28, 30 and a plurality of housing pairs 32, 34. The stabilizer 10 of the present invention advantageously prevents movement of the auger bit 14 except for in a linear direction along the longitudinal axis of the shaft 12. The stabilizer 10 effectively prevents the auger bit 14 from veering outwardly toward the walls of the hole being drilled.

As shown best by FIG. 3A, the stabilizer 10 is attached to the shaft 12 with the mounting arms 20, 22 and housings 32, 34. In the preferred embodiment, a first and second housings 32, 34 are shaped as cylindrical halves. There are flanges along the sides each of the housing 32, 24 for attachment to the other housing 32, 34. When the housings 32, 34 are mounted together they form a cylindrical band that fits closely about the outer diameter of the shaft 12. The clearance between the exterior of the shaft 12 and interior of the cylinder formed by the housings 32, 34 provides rotatable attachment of the stabilizer 10 to the shaft 12. To provide for such rotatable attachment, it should also be noted that the shaft 12 is different from the prior art. The shaft 12 is adapted to hold the housing at fixed positions along the longitudinal axis of the shaft 12. The stabilizer 10 is preferably mounted as close to the auger bit 14 as possible. Proximate the auger bit 14, a slot (not shown) is defined about the circumference of the shaft 12. The slot is formed by a pair of rings 36 mounted to the shaft 12. There is a similar slot further up along the shaft for the other housings 32, 34. The rings 36 advantageously hold the close fitting housings 32, 34 in their respective slots on the shaft 12. Therefore, as the shaft 12, blades 16, 18 and bit 14 rotate, the stabilizer 10 remains stationary.

The mounting arms 20, 22 are mounted to the housings 32, 34. The mounting arms 20, 22 preferably have a rectangular plate shape and are constructed of plates of metal. As shown in FIG. 3, the mounting arms 20, 22 preferably lie in the same plane. The first pair of mounting arms 20 are attached to the housing 32, 34 respectively and extend in opposite directions radially outward. Together the two housings 32, 34, and the two mounting arms 20 extend a distance about equal to the length of blade 18. Thus, the pair of mounting arms 20 form a blade against which the rotating blades 16, 18 can shear against for better mixture of the soil and chemical hardener being injected. The first and second mounting arms 20, 22 are preferably positioned spaced apart along the shaft 12 near the auger bit 14. The first pair of mounting arms 20 and respective housings 32, 34 are preferably mounted to the shaft 12 above blade 16. The second pair of mounting arms 22 are similarly attached to their respective housings 32, 34 and positioned below blade 16. Thus, there is a similar shearing effect for blade 16 and mounting arms 22.

At the ends of the mounting arms 20, 22 distal the housings 32, 34, the mounting arms 20, 22 are attached to the first and second stabilizing members 24, 26. Each stabilizing member 24, 26 is attached on opposite sides of the column being drilled. Near the top, each stabilizing member 24, 26 is attached to mounting arm 20, and near the bottom, each stabilizing member 24, 26 is attached to mounting arm 22. As shown best by FIG. 4, the stabilizing members 24, 26 preferably have a curved rectangular plate shape. In an exemplary embodiment, the stabilizing members 24, 26 are 1–2 feet long, $\frac{1}{4}$–$\frac{3}{4}$ inches thick and have 2–6 inch curved width. The curved shape of the stabilizing members 24, 26 advantageously provides a close fit with the wall of the column being drilled. Additionally, the mounting arms 20, 22 are of a suitable length to hold the first and second stabilizing members 24, 26 against the walls of the column being drilled. Thus, the first and second stabilizing members 24 prevent movement of the auger bit 14 in a first direction and force it in a straight direction.

Figure 3B:
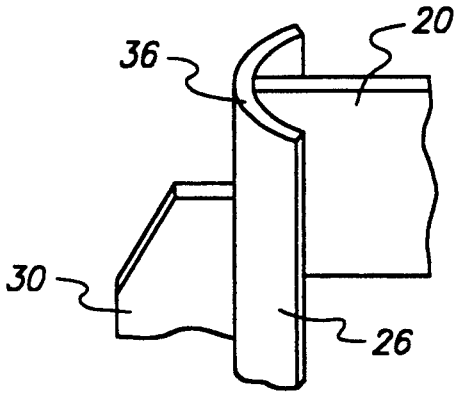
FIG. 3B is a perspective sectional view of the preferred embodiment of the stabilizer of the present invention.

While the stabilizing members 24, 26 restrict movement in the X and Y directions, they are designed to inhibit movement of the drilling apparatus along the axis of the shaft 12 as little as possible. As shown in FIG. 3B, a top edge 36 of the stabilizing members 24, 26 is preferably beveled or angled so that the stabilizing members 24, 26 can cut through the mixed soil as the drilling apparatus is removed from the ground. The bottom edges of the stabilizing members 24, 26 are similarly beveled for cutting through the soil as the column is drilled.

The stabilizing tabs 28, 30 also prevent the auger bit 14 from changing its drilling course in a second direction. The stabilizing tabs 28, 30 preferably have a trapezoidal plate shape as best seen in FIGS. 2 and 3. In an exemplary embodiment, each stabilizing tab is about $\frac{1}{2}$–1 foot long, $\frac{1}{2}$–2 inches wide and $\frac{1}{4}$–$\frac{3}{4}$ inches thick. This shape advantageously provides lower resistance as the stabilizer 10 moves up and down with the drilling shaft 12 as the column is drilled and the drilling apparatus is removed. The first and second stabilizing tabs 28, 30 are attached to the first and second stabilizing members 24, 26, respectively. The first and second tabs 28, 30 are preferably mounted in the same plane and extend radially outward from the shaft 12. As more particularly shown in FIG. 4, the first tab 28 is mounted so that it extends in a direction perpendicular to a tangent to the first stabilizing member 24. The second tab 30 is similarly attached to the second stabilizing member 26 and extends in the opposite direction, but perpendicular to a tangent to the second stabilizing member 26.

Figure 4:
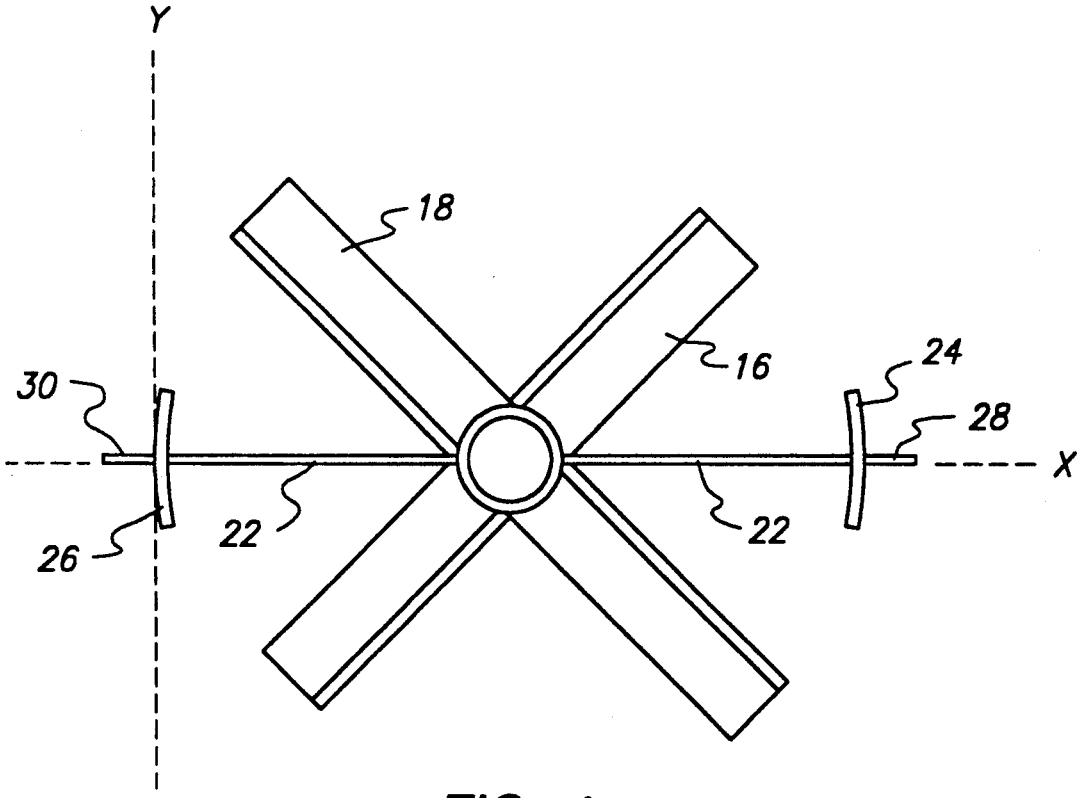
FIG. 4 is a cross-sectional view of the preferred embodiment of the stabilizer of the present invention mounted on the drilling system taken along 4—4 of FIG. 3A.

As best shown in FIG. 4, the stabilizer 10 of the present invention advantageously prevents movement of the auger bit 14 in two perpendicular axes of direction. In particularly, the X and Y axes of movement are shown in FIG. 4 by dashed lines. As can be seen, the first and second tabs 28, 30 extend into the walls of the hole being drill and prevent movement of the bit 14 in the Y direction. The first and second stabilizing members 24, 26 fit against the walls of the hole being drilled and prevent movement of the bit 14 in the X direction.

Thus, the stabilizer 10 of the present invention allows columns to be formed in horizontal and inclined positions.

Figure 5:
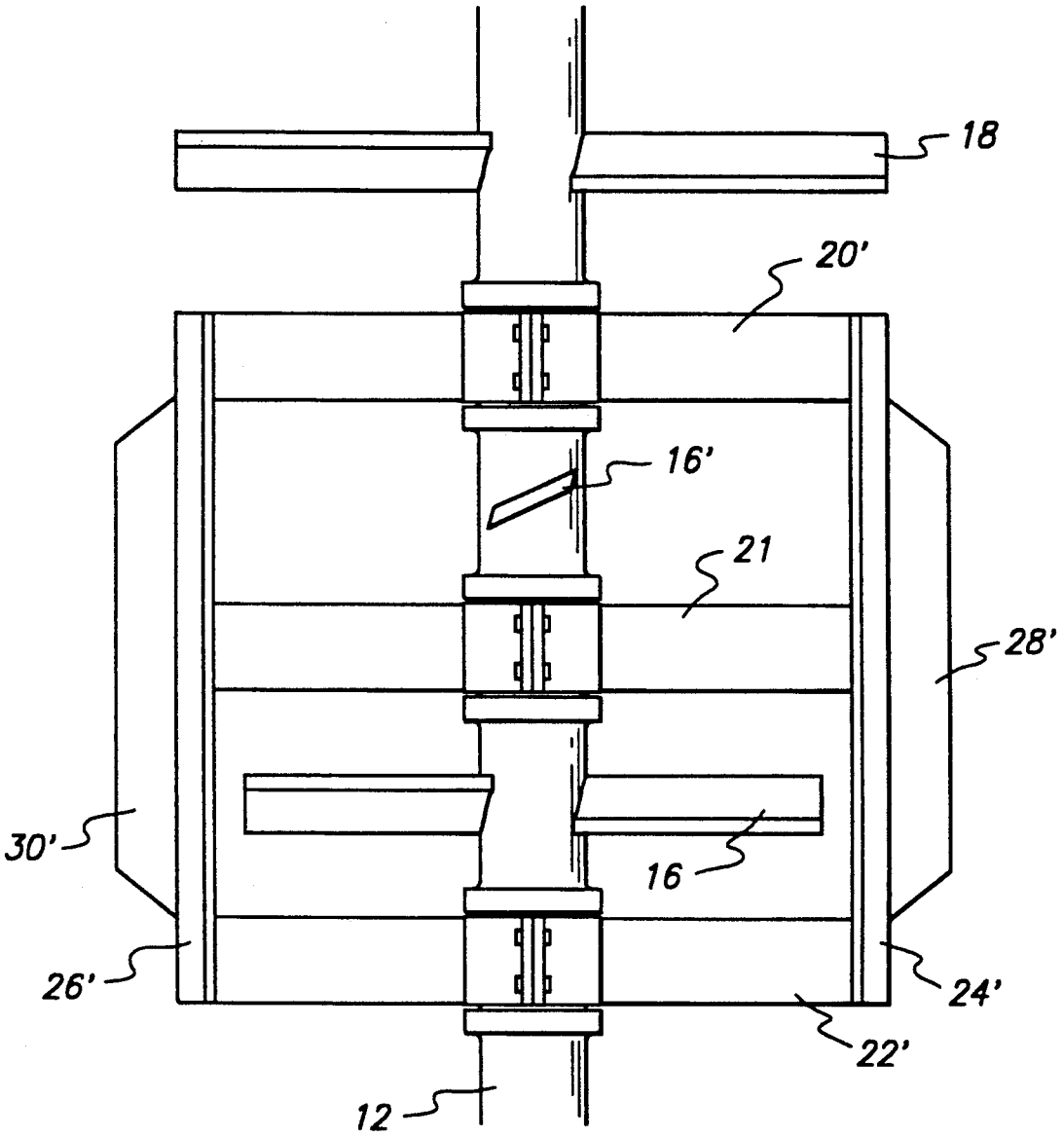
FIG. 5 is a side view of a second embodiment of the stabilizer of the present invention mounted on the drilling system.

Referring now to FIGS. 5 and 6, alternate embodiments of the present invention are shown. The alternate embodiments provide added stability beyond that with the preferred embodiment. FIG. 5 shows a second embodiment of the present invention in which the length of the stabilizing members 24', 26' and the stabilizing tabs 28', 30' has been increased. For example, their length is about 2–3 feet. By increasing the length of the members 24', 26' and tabs 28', 30', the stabilizer 10 is capable of providing additional force to prevent the auger bit 14 from veering or straying from a linear path. The second embodiment also includes three levels of mounting arms 20', 21', 22' as opposed to two in the preferred embodiment. The three levels of mounting arms 20', 21', 22' are attached to the shaft 12 in a similar manner as has been described above. As shown by FIG. 5, the three levels of mounting arms 20', 21', 22' are attached space apart along the length of the respective stabilizing members 24', 26' with the blades 16, 16' interposed between them. Thus, the second embodiment also realizes the improved mixing ability of the preferred embodiment because the blades 16, 16' shear against the three mounting arms 20', 21', 22'.

Figure 6A:
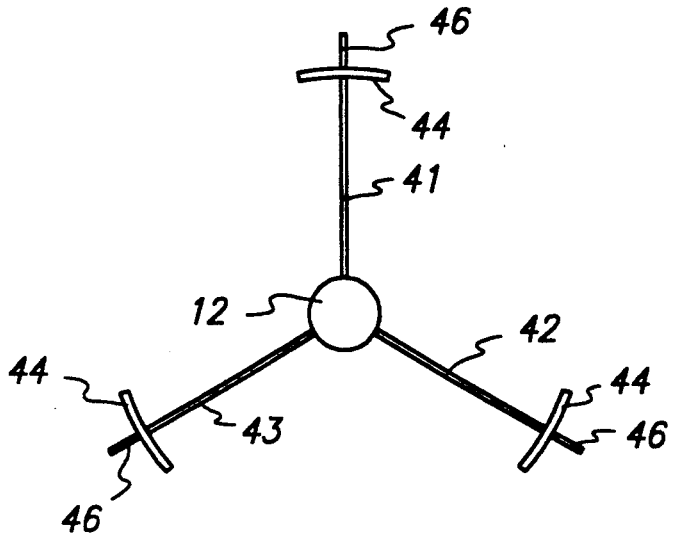
FIGS. 6A and 6B are cross-sectional views of the third embodiment for the stabilizer of the present invention.
Figure 6B:
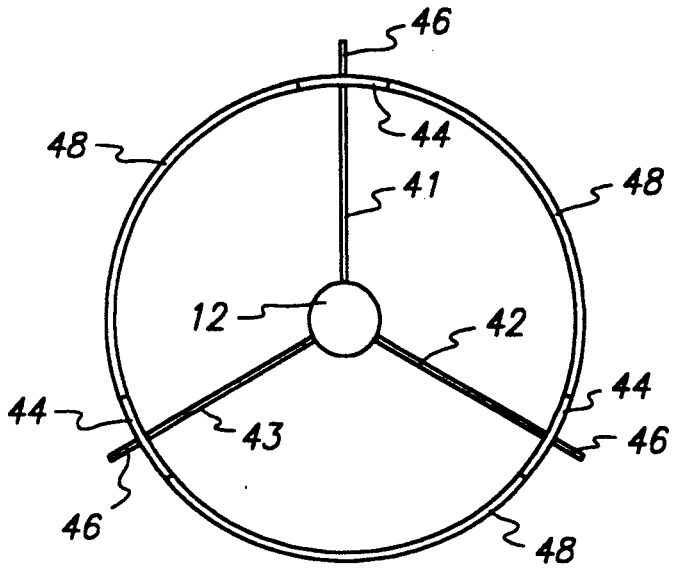
Figure 6C:
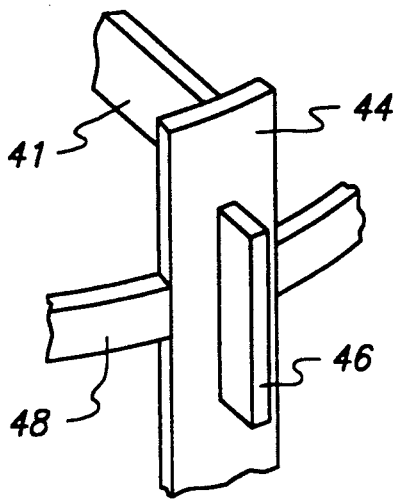
FIG. 6C is a perspective sectional view of the stabilizer of FIG. 6B including support bands.

Referring now to FIGS. 6A and 6B cross-sectional views of a third embodiment of the present invention are shown. In the embodiment of FIG. 6A, there are two sets of three mounting arms 41, 42, 43; one set for each level. The mounting arms 41, 42, 43 are attached on one end to the housings 32, 34. The mounting arms 41, 42, 43 extend radially outward from the shaft 12 and are spaced apart to divide the area about the shaft 12 into three equal sectors. Each of the mounting arms 41, 42, 43 is attached to a stabilizing member 44 and a tab 46. This embodiment advantageously provides additional support to prevent the auger bit (not shown) from leaving a linear path. The stabilizing members 44 and the tabs 46 are preferably similar to those in the preferred embodiment. As shown in FIGS. 6B and 6C, the third embodiment may further comprise three support bands 48. The support bands 48 are adapted to fit closely against the wall of the column being drilled. The bands 48 preferably have a curved plate structure like the stabilizing members 44. Each band 48 is coupled between a respective pair of stabilizing members 44. The ring structure formed by the attached bands 48 and stabilizing members 44 advantageously restricts movement of the auger bit except for along an axis in which the shaft lies.

Figure 7A:
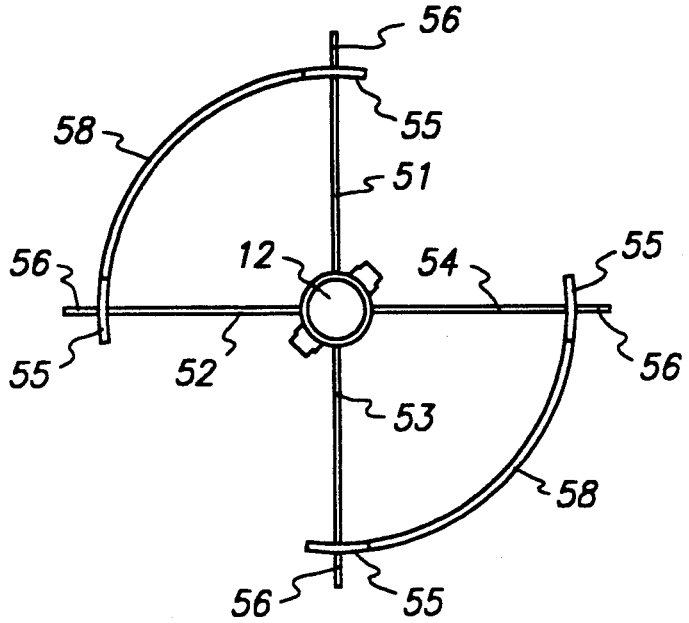
FIGS. 7A and 7B are cross-sectional views of the fourth embodiment for the stabilizer of the present invention.
Figure 7B:
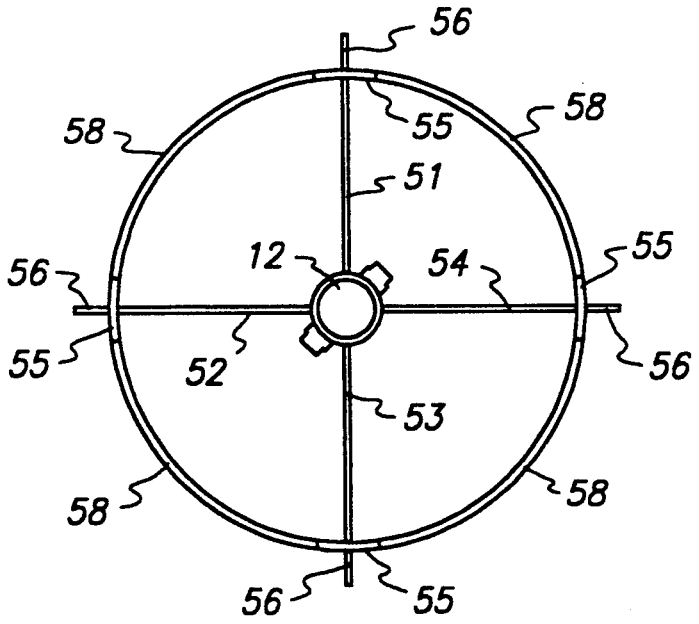

FIGS. 7A and 7B illustrate the fourth embodiment of the present invention. The fourth embodiment of the present invention provides an even greater stabilizing effect than the third embodiment. The fourth embodiment preferably includes two sets of four mounting arms 51, 52, 53, 54. The four mounting arms 51, 52, 53, 54 extend radially outward from the shaft 12 and are spaced apart to divide the area about the shaft 12 into four equal sectors. Each of the mounting arms 51, 52, 53, 54 is attached to a stabilizing member 55 and a tab 56 similar to the other embodiments previously described. Like the third embodiment, the fourth embodiment may also include a plurality of bands 58 attached between the stabilizing members 55. The bands 58 are preferably curved for a close fit with the walls of the column. For example, there may be two bands 58 as shown in FIG. 7A, one attached between the stabilizing members 55 attached to mounting arms 51 and 54, and the other attached between the stabilizing members 55 attached to mounting arms 52 and 53. Alternatively, four bands 58 as shown in FIG. 7B with a band 58 between each stabilizing member 55 may be used. Each band 58 preferably extends across slightly less than a fourth of the circumference of the hole. Thus, each band 58 restrict movement of the auger bit 14 in both the X and Y directions.

Having described the present invention with reference to specific embodiments, the above description is intended to illustrate the operation of the preferred embodiments and is not meant to limit the scope of the invention. The scope of the invention is to be delimited only by the following claims. From the above discussion, many variations will be apparent to one skilled in the art that would yet be encompassed by the true spirit and scope of the present invention.

What is claimed is:

1. A stabilizer for preventing changes in the drilling direction of an in situ column drilling system having a shaft and an auger bit, said stabilizer comprising:

a first and a second set of mounting arms, each of said mounting arms adapted for rotatable coupling to a shaft of the drilling system, said first and second set of mounting arms coupled to the shaft spaced apart along a longitudinal axis of the shaft proximate the auger bit, the longitudinal axis extending in the drilling direction;

first and second stabilizing members for preventing movement of the auger bit in a first direction, the first stabilizing member attached to ends of the first and second set of mounting arms, the first stabilizing member extending parallel to and about the longitudinal axis of the shaft between the ends of the first and second set of mounting arms, and the second stabilizing member attached to ends of the first and second set of mounting arms distal the first stabilizing member, the second stabilizing member extending parallel to and about the longitudinal axis of the shaft between the ends of the first and second set of mounting arms, the first and second stabilizing members having a plate shape, the first and second stabilizing members having a curved, semi-cylindrical shape and being curved about the longitudinal axis of the shaft for a close fit with a wall of the column; and first and second stabilizing tabs for preventing movement of the auger bit in a second direction, said first and second stabilizing tabs mounted to the first and second stabilizing members, respectively, said first and second stabilizing tabs mounted parallel to the longitudinal axis of the shaft and extending radially outward from the respective stabilizing members.

2. The stabilizer of claim 1, further comprising a plurality of housing pairs for providing rotatable coupling of the first and second set of mounting arms to the shaft, each housing pair forming a cylinder with a close fit with the shaft to which the mounting arms are attached.

3. The stabilizer of claim 1, wherein the respective stabilizing members and stabilizing tab are attached in substantially perpendicular planes to restrict movement of the drilling system in two directions.

4. The stabilizer of claim 1, wherein the first and second set of mounting arms are positioned spaced apart along the longitudinal axis of the shaft with a blade of the drilling system between the first and second sets of mounting arms.

5. The stabilizer of claim 1, wherein the first and second stabilizing tabs have a trapezoidal plate shape; and the top and bottom edges of the first and second stabilizing members are beveled for reduced resistance to movement in the direction of the longitudinal axis of the shaft.

6. The stabilizer of claim 1, further comprising:

a third stabilizing member adapted for a close fit against a portion of the wall of the column;

a third stabilizing tab mounted to the third stabilizing member, said third stabilizing tab mounted parallel to the longitudinal axis of the shaft and extending radially outward from the third stabilizing member; and wherein each set of mounting arms includes three mounting arms extending radially outward and spaced apart along the circumference of the shaft, each of said mounting arms coupled to a respective stabilizing member.

7. The stabilizer of claim 6, further comprising a plurality of support bands, each of said bands shaped for a close fit with the column, and each support band attached between two of the first, second and third stabilizing members.

8. The stabilizer of claim 1, further comprising:

a third and fourth stabilizing plate members adapted for a close fit against a portion of the wall of the column;

a third and fourth stabilizing tabs mounted to the third and fourth stabilizing members, respectively, said third and fourth stabilizing tabs mounted parallel to the longitudinal axis of the shaft and extending radially outward from the third stabilizing member; and wherein each set of mounting arms includes four mounting arms extending radially outward and spaced apart along the circumference of the shaft, each of said mounting arms coupled to a respective stabilizing member.

9. The stabilizer of claim 8, further comprising a plurality of support bands, each of said bands shaped for a close fit with the column, and each support band attached between two of the first, second, third and fourth stabilizing members.

10. The stabilizer of claim 1, wherein the first and second stabilizing members and the first and second stabilizing tabs each extend a distance of at least two feet along the longitudinal axis of the shaft.

* * * * *